US007589467B2

(12) United States Patent
Park

(10) Patent No.: US 7,589,467 B2
(45) Date of Patent: Sep. 15, 2009

(54) PLASMA DISPLAY PANEL COMPRISING ELECTRODE PAD

(75) Inventor: Min Soo Park, Seoul (KR)

(73) Assignee: LG Electronics Inc., Seoul (KR)

( * ) Notice: Subject to any disclaimer, the term of this patent is extended or adjusted under 35 U.S.C. 154(b) by 563 days.

(21) Appl. No.: 11/296,353

(22) Filed: Dec. 8, 2005

(65) Prior Publication Data

US 2006/0119270 A1 Jun. 8, 2006

(30) Foreign Application Priority Data

Dec. 8, 2004 (KR) ..... 10-2004-0103273

(51) Int. Cl.
*H01J 17/49* (2006.01)

(52) U.S. Cl. ..... 313/583

(58) Field of Classification Search ..... None
See application file for complete search history.

(56) References Cited

U.S. PATENT DOCUMENTS 6,343,967 B1 2/2002 Nishiki et al.
6,555,956 B1 * 4/2003 Kim ..... 313/491
6,621,215 B1 * 9/2003 Su et al. ..... 313/582
6,624,574 B1 * 9/2003 Cho et al. ..... 313/582
7,230,381 B2 * 6/2007 Ohkubo et al. ..... 313/587
7,348,728 B2 * 3/2008 Kim et al. ..... 313/583
7,397,187 B2 * 7/2008 Kwon et al. ..... 313/583
2002/0089285 A1 7/2002 Nishiki et al.
2005/0231117 A1 * 10/2005 Joo et al. ..... 313/586

FOREIGN PATENT DOCUMENTS

KR 1999-0072346 A 9/1999
KR 2000-0056712 A 9/2000

* cited by examiner

*Primary Examiner*—Ashok Patel
(74) *Attorney, Agent, or Firm*—Birch, Stewart, Kolasch & Birch, LLP

(57) ABSTRACT

The present invention relates to a plasma display panel comprising an electrode pad. The plasma display panel of the present invention comprises an electrode formed in a first region of a substrate, and an auxiliary pad and an electrode pad formed in a second region of the substrate. Therefore, since adhesive force between the auxiliary pad and the electrode pad is improved, a phenomenon in which the electrode pad are fallen off can be prevented.

6 Claims, 8 Drawing Sheets

PLASMA DISPLAY PANEL COMPRISING ELECTRODE PAD

CROSS-REFERENCES TO RELATED APPLICATIONS

This Nonprovisional application claims priority under 35 U.S.C. § 119(a) on Patent Application No. 2004-0103273 filed in Korea on Dec. 08, 2004 the entire contents of which are hereby incorporated by reference.

BACKGROUND OF THE INVENTION

1. Field of the Invention

The present invention relates to a plasma display panel comprising an electrode pad.

2. Background of the Related Art

A general plasma display panel is a kind of a light-emitting type device that displays images using an inter-electrode gas discharge phenomenon between two sheets of glass substrates. In a general plasma display panel, there is no need for an active element for driving each cell. Therefore, a manufacturing process of the plasma display panel is simple, the screen can be made large and a response speed is fast.

In a general plasma display panel, images are implemented on a front substrate 100. A central region of the front substrate 100 is a cell region 100*a* on which light emission is generated. Furthermore, an electrode pad region 100*b*, i.e., a region where an electrode pad is formed is located outside the cell region 100*a*. The electrode pad electrically connects a driving circuit of the plasma display panel and electrodes of the plasma display panel.

FIG. 1 shows a process of forming an electrode in a front substrate of a plasma display panel in the related art. As shown in FIG. 1, a transparent electrode material is deposited within the cell region 100*a* of the front substrate 100. As the transparent electrode material is etched along the transparent electrode pattern, a transparent electrode 101 is formed.

If the transparent electrode 101 is formed, a black matrix forming material 102 is formed on the transparent electrode 101 through the screen printing method. The black matrix forming material 102 is printed only in the cell region 100*a* where light emission is generated in order to reduce an amount of printing consumed. The black matrix forming material 102 is etched along the black matrix pattern, forming a black matrix 102'.

After an electrode material is printed on the black matrix 102' and in the electrode pad region 100*b*, bus electrodes 103 are formed on the black matrix 102' and an electrode pad 104 are formed in the electrode pad region 100*b* through exposure and development processes depending on the bus electrode pattern.

When the bus electrodes 103 and the black matrix 102' formed in the cell region 100*a* are sintered, the bus electrodes 103 and the black matrix 102' are brought in contact with each other. Therefore, adhesive force of the bus electrodes 103 and the black matrix 102' is increased while the bus electrodes 103 and the black matrix 102' are partially mixed.

However, the black matrix 102' is not formed in the electrode pad region 100*b*, but only the electrode pads 104 formed of the same material as that of the bus electrodes 103 is formed in the electrode pad region 100*b*. Therefore, the electrode pads 104 are directly brought in contact with the front substrate 100.

FIG. 2 is a cross-sectional view of the plasma display panel taken along line A-A' in FIG. 1. As shown in FIG. 2, the electrode pads 104 are directly brought in contact with the front substrate 100. Therefore, adhesive force between the electrode pads 104 and the front substrate 100 is lowered. In the manufacture process of the plasma display panel, the driving circuit and the electrode pads 104 are electrically connected by a film type element, such as a Flexible Printed Circuit (FPC). A phenomenon in which the electrode pads 104 are fallen off from the front substrate 100 due to weak adhesive force between the electrode pads 104 and the front substrate 100 when the FPC is connected to the electrode pads 104 occurs.

SUMMARY OF THE INVENTION

Accordingly, an object of the present invention is to solve at least the problems and disadvantages of the background art.

It is an object of the present invention to provide a plasma display panel in which adhesive force of an electrode pad is increased.

A plasma display panel according to an embodiment of the present invention comprises a substrate, an electrode formed in a first region of the substrate, an auxiliary pad formed in a second region of the substrate, and an electrode pad formed on the auxiliary pad, for transferring an externally input driving pulse to the electrodes.

A plasma display panel according to an embodiment of the present invention comprises a substrate, a transparent electrode formed in a first region of the substrate, a bus electrode formed on the transparent electrode, a transparent electrode pad formed in a second region of the substrate, and a bus electrode pad formed on the transparent electrode pad, for transferring an externally supplied driving pulse to the bus electrode.

A plasma display panel according to an embodiment of the present invention comprises a substrate, a black matrix formed in a first region of the substrate, an electrode formed on the black matrix, a black pad formed in a second region of the substrate, and an electrode pad formed on the black pad, for transferring an externally supplied driving pulse to the electrode.

In accordance with a plasma display panel according to the present invention, an auxiliary pad, which are heterogeneous to a bus electrode pad, are formed between a bus electrode pad and a substrate. Therefore, since adhesive force of the bus electrode pad is increased, the bus electrode pad can be prevented from falling off.

BRIEF DESCRIPTION OF THE DRAWINGS

The invention will be described in detail with reference to the following drawings in which like numerals refer to like elements.

DETAILED DESCRIPTION OF THE PREFERRED EMBODIMENT

Preferred embodiments of the present invention will be described in a more detailed manner with reference to the drawings.

A plasma display panel according to an embodiment of the present invention comprises a substrate, an electrode formed in a first region of the substrate, an auxiliary pad formed in a second region of the substrate, and an electrode pad formed on the auxiliary pad, for transferring an externally input driving pulse to the electrode.

The plasma display panel further comprises another auxiliary pad formed between the substrate and the auxiliary pad.

The electrode and the electrode pad comprise the same material.

The electrode is a bus electrode comprising a metal material, and the electrode pad is a bus electrode pad formed of a metal material.

The first region is a discharge region where a discharge is generated and the second region is a non-discharge region where a discharge is not generated.

A plasma display panel according to an embodiment of the present invention comprises a substrate, a transparent electrode formed in a first region of the substrate, a bus electrode formed on the transparent electrode, a transparent electrode pad formed in a second region of the substrate, and a bus electrode pad formed on the transparent electrode pad, for transferring an externally supplied driving pulse to the bus electrode.

The transparent electrode and the transparent electrode pad comprise the same material.

The material is ITO.

A width of the transparent electrode pad is wider than the width of the transparent electrode.

The transparent electrode and the transparent electrode pad are spaced apart from each other.

The plasma display panel further comprises a black matrix formed between the transparent electrode and the bus electrode, and a black pad formed between the transparent electrode pad and the bus electrode pad.

The black matrix and the black pad are formed of the same material.

The black matrix and the black pad are spaced apart from each other.

The first region is a discharge region where a discharge is generated and the second region is a non-discharge region where a discharge is not generated.

A plasma display panel according to an embodiment of the present invention comprises a substrate, a black matrix formed in a first region of the substrate, an electrode formed on the black matrix, a black pad formed in a second region of the substrate, and an electrode pad formed on the black pad, for transferring an externally supplied driving pulse to the electrode.

The black matrix and the black pad comprise the same material.

The black matrix and the black pad are spaced apart from each other.

The first region is a discharge region where a discharge is generated and the second region is a non-discharge region where a discharge is not generated.

Embodiments of the present invention will now be described in detail with reference to the accompanying drawings.

Embodiment 1

Figure 1:
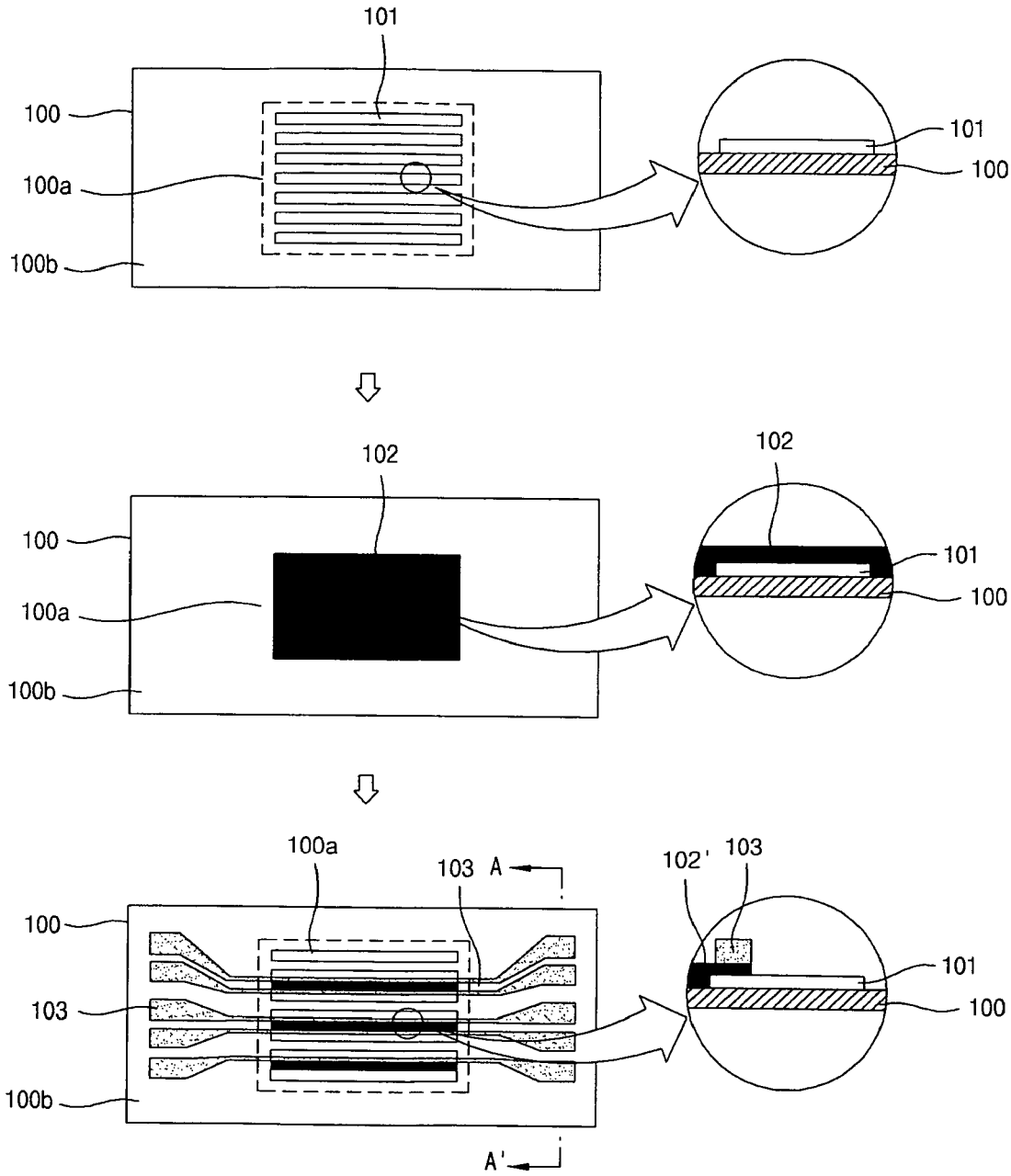
FIG. 1 shows a process of forming an electrode in a front substrate of a plasma display panel in the related art.
Figure 2:
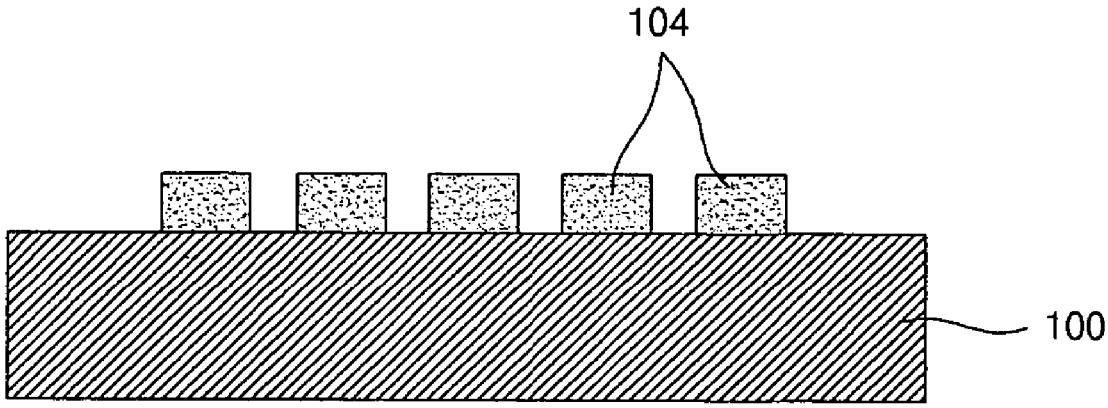
FIG. 2 is a cross-sectional view of the plasma display panel taken along line A-A' in FIG. 1.
Figure 3:
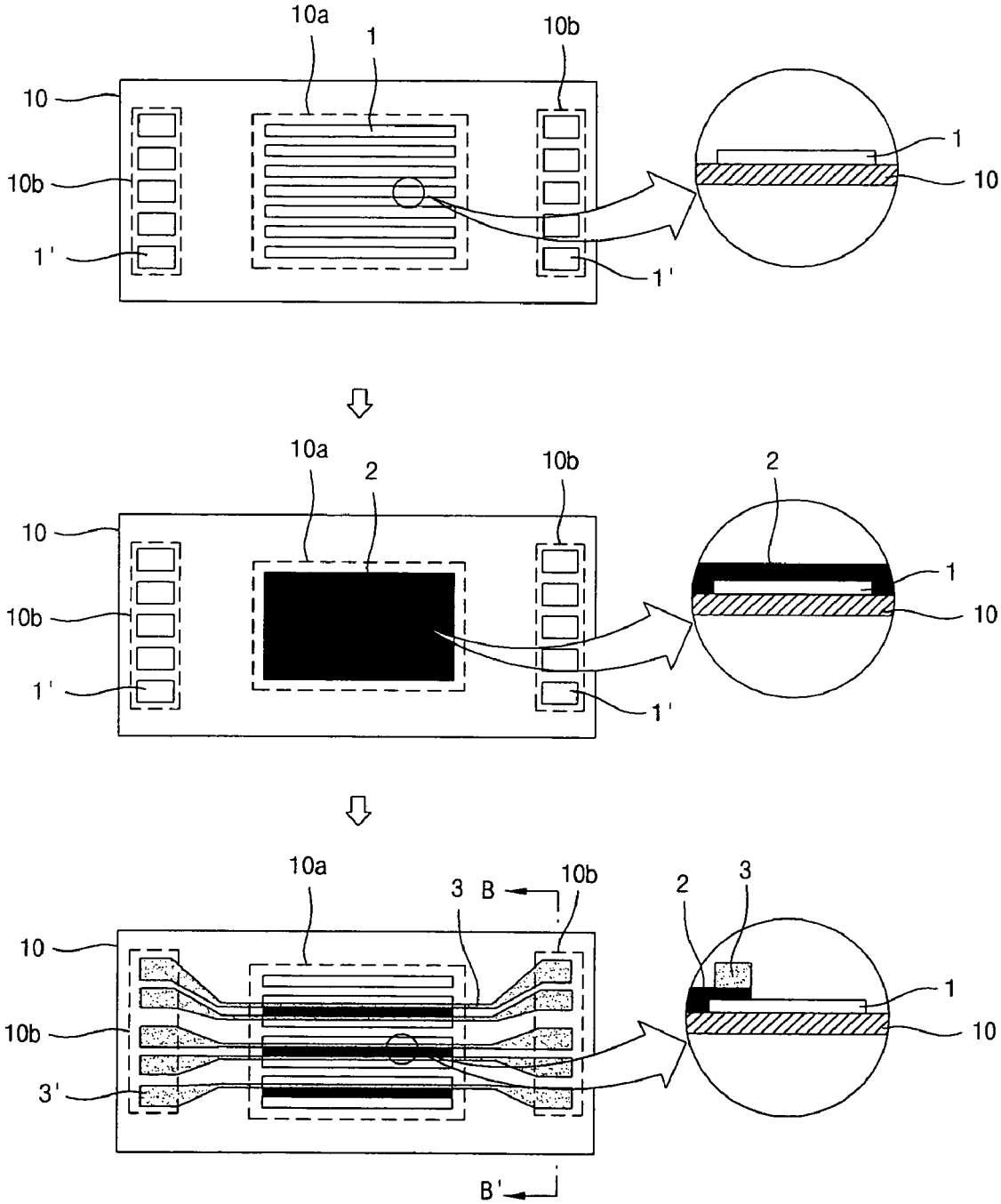
FIG. 3 shows a process of forming an electrode pad in a substrate according to a first embodiment of the present invention.

FIG. 3 shows a process of forming an electrode pad in a substrate according to a first embodiment of the present invention. As shown in FIG. 3, a process of forming an electrode pad according to a first embodiment of the present invention consists of three steps.

In the first step, a transparent electrode material is deposited on a substrate 10. As the transparent electrode material is etched along patterns of a transparent electrode 1 and a transparent electrode pad 1', the transparent electrode 1 and the transparent electrode pad 1'are formed in a cell region 10*a* and an electrode pad region 10*b* at the same time. A width of each of the transparent electrode pad 1' is wider than the width of each of the transparent electrode 1. The transparent electrode pad 1' and the transparent electrode 1 are spaced apart from each other. Furthermore, the transparent electrode material comprises Indium Tin Oxide (ITO). The cell region 10*a* is included in a discharge region in which a discharge is generated. The electrode pad region 10*b* is included in a non-discharge region in which a discharge is not generated.

In the second step, a black matrix forming material 2 is formed on the transparent electrode 1 through the screen printing method. The black matrix forming material 2 is printed only in the cell region 10*a*. As the black matrix forming material 2 is etched along the black matrix pattern, a black matrix 2 is formed on the transparent electrode 1. Therefore, the transparent electrode 1 and the black matrix 2 are exposed in the cell region 10*a* of the substrate 10, and the transparent electrode 1' are exposed in the electrode pad region 10*b* on the right and lefts sides of the cell region 10*a*.

In the third step, a bus electrode material is printed on the black matrix 2 and the transparent electrode pad 1' of the electrode pad region lob. As the bus electrode material is etched along the bus electrode pattern and the bus electrode pad pattern, the bus electrode 3 is formed on the black matrix 2 of the cell region 10*a*, and at the same time, the bus electrode pad 3' is formed on the transparent electrode pad 1' of the electrode pad region 10*b*.

That is, according to a first embodiment of the present invention, the transparent electrode 1, the black matrix 2 and the bus electrode 3 are sequentially stacked on the cell region 10*a*, and the transparent electrode pad 1' and the bus electrode pad 3' are sequentially stacked on the electrode pad region 10*b*.

Figure 4:
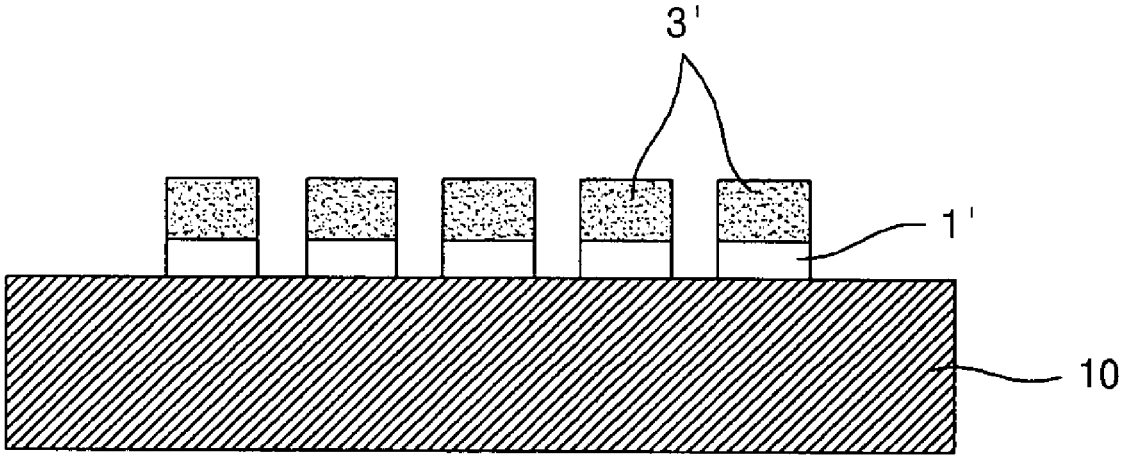
FIG. 4 is a cross-sectional view of FIG. 3 taken along line B-B'.

FIG. 4 is a cross-sectional view of FIG. 3 taken along line B-B'. As shown in FIG. 4, the transparent electrode pad 1' serving as an auxiliary pad are formed between the bus electrode pad 3' and the substrate 10 in the electrode pad region 10*b* of the substrate 10 without an additional process. That is, as described with reference to FIG. 3, the transparent electrode pad 1' and the bus electrode pad 3' are formed simultaneously with the transparent electrode 1 and the bus electrode 3. Therefore, there is no need for an additional process for forming the transparent electrode pad 1' and the bus electrode pad 3'. Since the bus electrode pad 3' are formed on the transparent electrode pad 1', good adhesive force can be formed between the bus electrode pad 3' and the transparent electrode pad 1'. That is, the transparent electrode pad 1' form good adhesive force along with the substrate 10 and forms good adhesive force along with the bus electrode pad 3'. Therefore, a phenomenon in which the bus electrode pad 3' are fallen off from the substrate 10 when a film type element such as a FPC and the bus electrode pad 3' are connected can be reduced.

Embodiment 2

Figure 5:
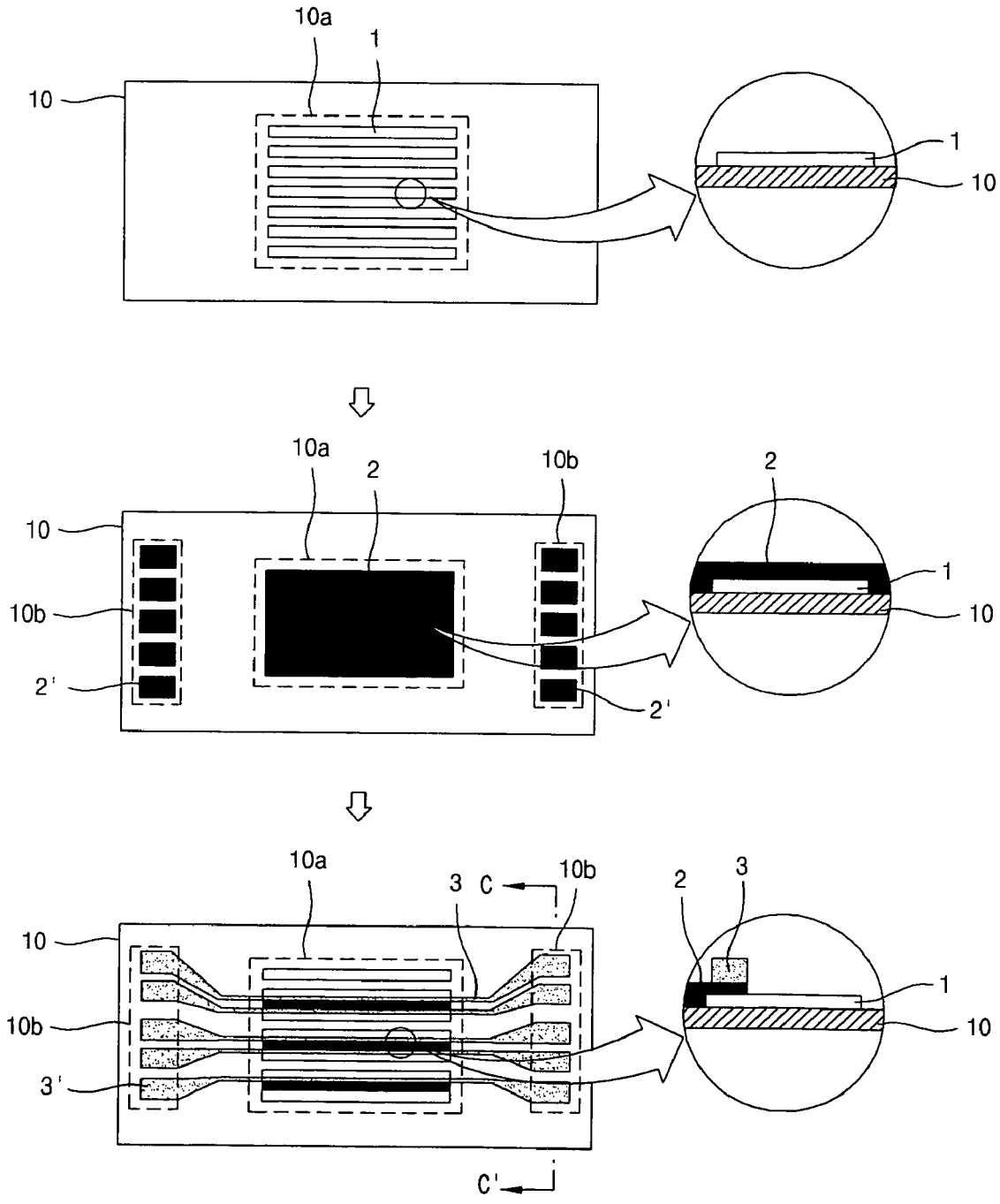
FIG. 5 shows a process of forming an electrode pad in a substrate according to a second embodiment of the present invention.

FIG. 5 shows a process of forming an electrode pad in a substrate according to a second embodiment of the present invention. As shown in. FIG. 5, the process of forming the electrode pad according to a second embodiment of the present invention consists of three steps.

In the first step, a transparent electrode material is deposited on a substrate 10. As the transparent electrode material is etched along the pattern of transparent electrode 1, the transparent electrode 1 is formed in a cell region 10*a*. The transparent electrode material comprises ITO.

In the second step, a black matrix forming material 2 is formed on the transparent electrode 1 of the cell region 10*a* and in an electrode pad region 10*b* through the screen printing method. As the black matrix forming material 2 is etched along the black matrix pattern and the electrode pad pattern, a black matrix 2 is formed on the transparent electrode 1 of the cell regions 10*a* and a black pad 2' are formed on the electrode pad region 10*b*. A width of the black pad 2' is wider than the width of the black matrix 2. The black pad 2' and the black matrix 2 are spaced apart from each other. Therefore, the transparent electrode 1 and the black matrix 2 are exposed in the cell region 10*a* of the substrate 10, and the black pad 2' are exposed in the electrode pad region 10*b* on the right and lefts sides of the cell region 10*a*. The cell region 10*a* is included in a discharge region in which a discharge is generated. The electrode pad region 10*b* is included in a non-discharge region in which a discharge is not generated.

In the third step, a bus electrode material is printed on the black matrix 2 and the transparent electrode pad 1' of the electrode pad region 10*b*. As the bus electrode material is etched along the bus electrode pattern and the bus electrode pad pattern, the bus electrode 3 is formed on the black matrix 2 of the cell region 10*a*, and at the same time, a bus electrode pad 3' are formed on the transparent electrode pad 1' of the electrode pad region 10*b*.

That is, according to a second embodiment of the present invention, the transparent electrode 1, the black matrix 2 and the bus electrode 3 are sequentially stacked on the cell region 10*a*, and the black pad 2' and the bus electrode pad 3' are sequentially stacked on the electrode pad region lob.

Figure 6:
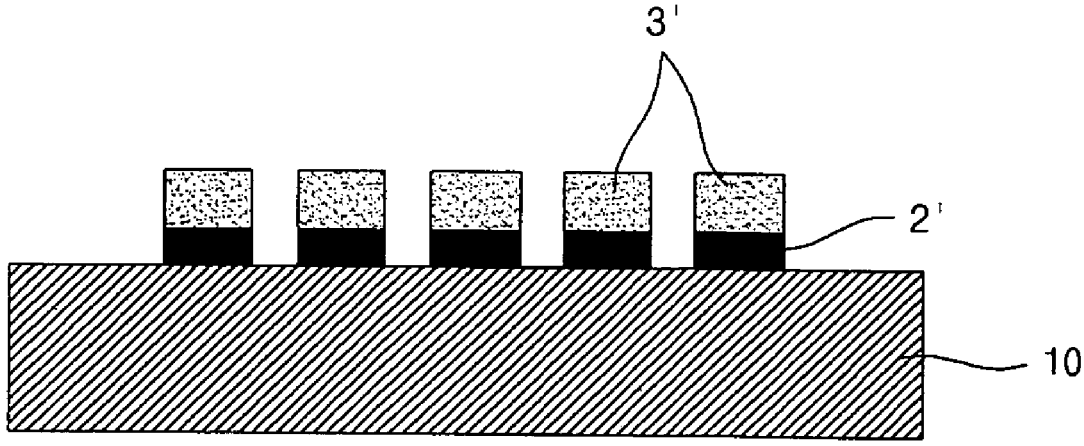
FIG. 6 is a cross-sectional view of FIG. 5 taken along line C-C'.

FIG. 6 is a cross-sectional view of FIG. 5 taken along line C-C'. As shown in FIG. 6, the black pad 2' serving as an auxiliary pad is formed between the bus electrode pad 3' and the substrate 10 in the electrode pad region 10*b* of the substrate 10 without an additional process. That is, as described with reference to FIG. 5, the black pad 2' and the bus electrode pad 3' are formed simultaneously with the black matrix 2 and the bus electrode 3. Therefore, an additional process for forming the black pad 2' and the bus electrode pad 3' is not required. Since the bus electrode pad 3' is formed on the black pad 2', good adhesive force can be formed between the bus electrode pad 3' and the black pad 2'. That is, the black pad 2' forms good adhesive force along with the substrate 10 and forms good adhesive force along with the bus electrode pad 3'. Therefore, a phenomenon in which the bus electrode pad 3' are fallen off from the substrate 10 when a film type element such as a FPC and the bus electrode pad 3' are connected can be reduced.

Embodiment 3

Figure 7:
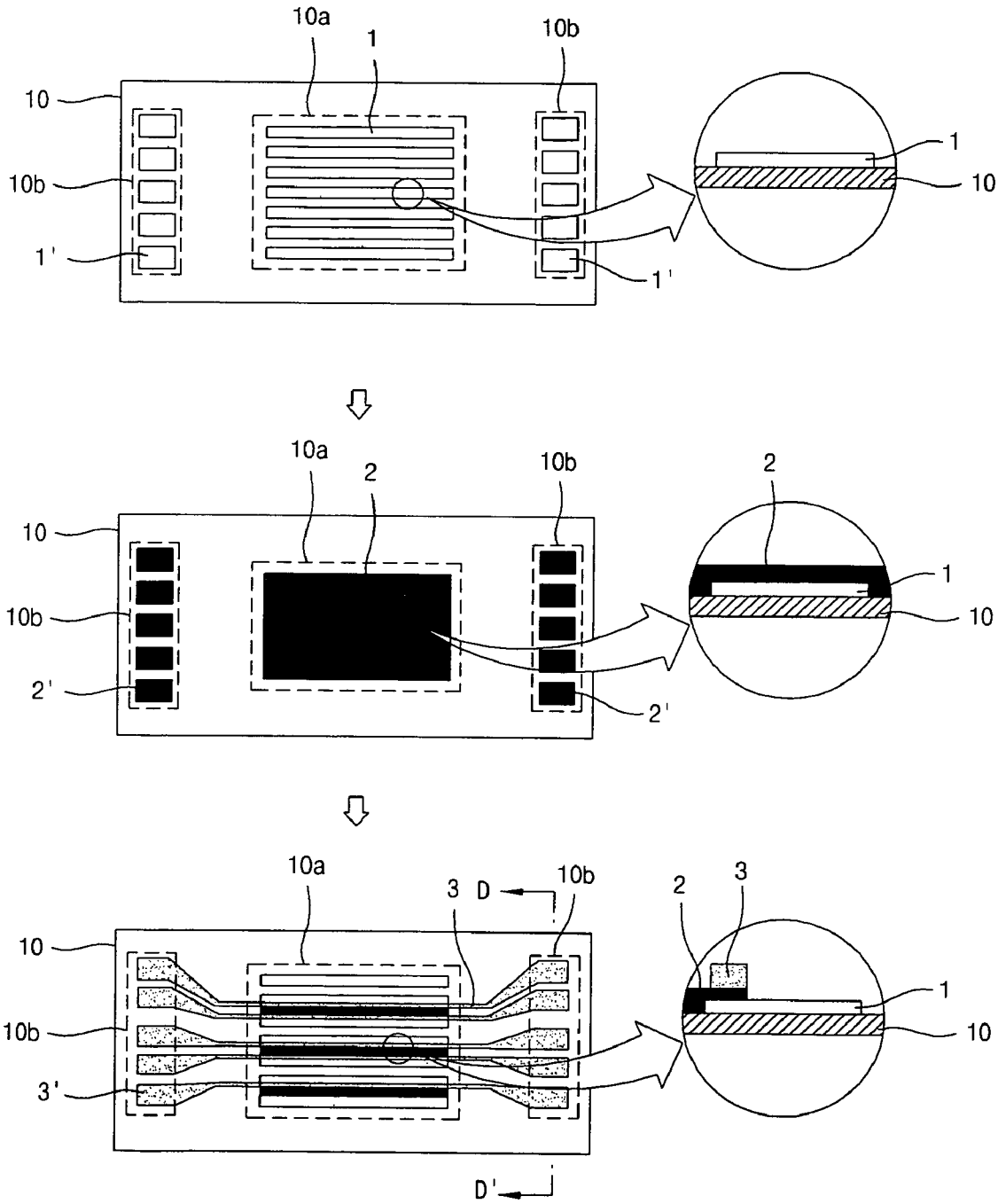
FIG. 7 shows a process of forming an electrode pad in a substrate according to a third embodiment of the present invention.

FIG. 7 shows a process of forming an electrode pad in a substrate according to a third embodiment of the present invention. As shown in FIG. 7, a process of forming an electrode pad according to a third embodiment of the present invention consists of three steps.

In the first step, a transparent electrode material is deposited on a substrate 10. As the transparent electrode material is etched along patterns of transparent electrode 1 and a transparent electrode pad 1', the transparent electrode 1 and the transparent electrode pad 1' are formed in a cell region 10*a* and an electrode pad region 10*b* at the same time. A width of each of the transparent electrode pad 1' is wider than the width of each of the transparent electrode 1. The transparent electrode pad 1' and the transparent electrode 1 are spaced apart from each other. Furthermore, the transparent electrode material comprises Indium Tin Oxide (ITO). The cell region 10*a* is included in a discharge region in which a discharge is generated. The electrode pad region 10*b* is included in a non-discharge region in which a discharge is not generated.

In a second step, a black matrix forming material 2 is formed on the transparent electrode 1 and the transparent electrode pad 1' through the screen printing method. The black matrix forming material 102 is formed along the black matrix pattern and the pattern of the electrode pad, forming a black matrix 2 on the transparent electrode 1 and a black pad 2' on the transparent electrode pad 1'. A width of the black pad 2' is wider than the width of the black matrix 2. The black pad 2' and the black matrix 2 are spaced apart from each other.

In a third step, a bus electrode material is printed on the black matrix 2 of the cell region 10*a* and on the black pad 2' of the electrode pad region 10*b*. The bus electrode material is etched along the bus electrode pattern and the pattern of the electrode pad pattern, forming a bus electrode 3 on the black matrix 2 of the cell region 10*a* and a bus electrode pad 3' on the black pad 2' of the electrode pad region 10*b*.

That is, according to a third embodiment of the present invention, the transparent electrode 1, the black matrix 2 and the bus electrode 3 are sequentially stacked on the cell region 10*a*, and the transparent electrode pad 1', the black pad 2' and the bus electrode pad 3' are sequentially stacked on the electrode pad region 10*a*.

Figure 8:
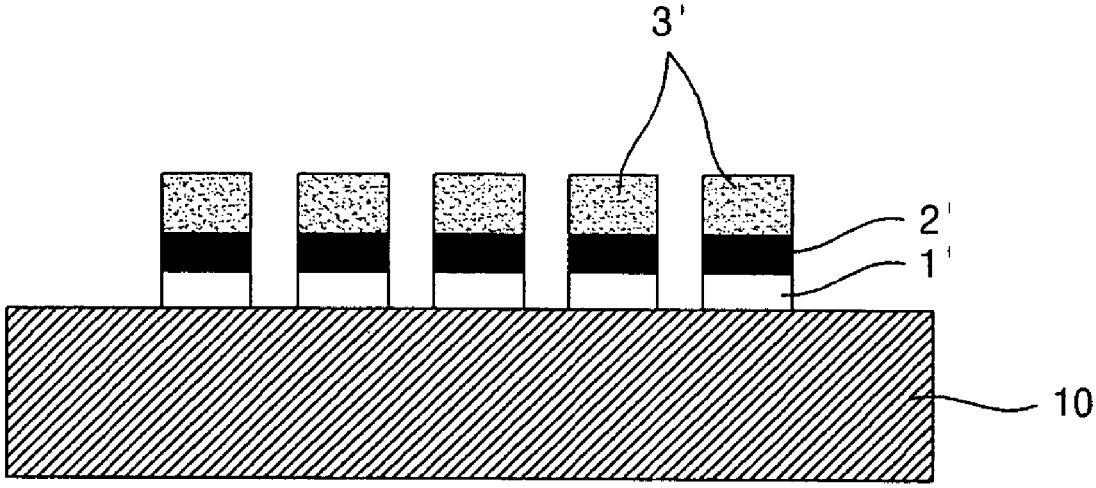
FIG. 8 is a cross-sectional view of FIG. 7 taken along line D-D'.

FIG. 8 is a cross-sectional view of FIG. 7 taken along line D-D'. As shown in FIG. 8, the transparent electrode pad 1' and the black pad 2' serving as an auxiliary pad is formed between the bus electrode pad 3' and the substrate 10 in the electrode pad region 10*b* of the substrate 10 without an additional process. That is, as described with reference to FIG. 7, the transparent electrode pad 1' and the black pad 2' and the bus electrode pad 3' are formed simultaneously with the transparent electrode 1, the black matrix 2 and the bus electrode 3. Therefore, an additional process for forming the transparent electrode pad 1', the black pad 2' and the bus electrode pad 3' is not required. Since the bus electrode pad 3' is formed on the black pad 2', good adhesive force can be formed between the bus electrode pad 3' and the black pad 2'. That is, the transparent electrode pad 1' form good adhesive force along with the substrate 10 and the black pad 2', and the black pad 2' forms good adhesive force along with the bus electrode pad 3'. Therefore, a phenomenon in which the bus electrode pad 3' are fallen off from the substrate 10 when a film type element such as a FPC and the bus electrode 3' are connected can be reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel, comprising:

a substrate;

an electrode formed in a first region of the substrate;

an auxiliary pad formed in a second region of the substrate; and an electrode pad formed on the auxiliary pad and above a region not covered by the first region and configured to transfer an externally input driving pulse to the electrode.

2. The plasma display panel as claimed in claim 1, further comprising another auxiliary pad formed between the substrate and the auxiliary pad.

3. The plasma display panel as claimed in claim 1, wherein the electrode and the electrode pad comprise the same material.

4. The plasma display panel as claimed in claim 1, wherein the electrode is a bus electrode comprising a metal material, and the electrode pad is a bus electrode pad comprising a metal material.

5. The plasma display panel as claimed in claim 1, wherein the first region is a discharge region where a discharge is generated and the second region is a non-discharge region where a discharge is not generated.

6. The plasma display panel as recited in claim 1, wherein the auxiliary pad is formed of indium-tin-oxide (ITO).

* * * * *